United States Patent [19]

Bartling, Sr.

[11] 4,144,824

[45] Mar. 20, 1979

[54] INCINERATING AND ENERGY CONVERTING APPARATUS

[76] Inventor: Leonard C. Bartling, Sr., 476 S. Park Ave., Webster Groves, Mo. 63119

[21] Appl. No.: 856,651

[22] Filed: Dec. 2, 1977

[51] Int. Cl.[2] ..... F23G 5/12

[52] U.S. Cl. ..... 110/214; 110/116; 110/216; 110/240

[58] Field of Search ..... 110/116, 214, 216, 240, 110/248

[56] References Cited

U.S. PATENT DOCUMENTS

| | | | |
|---|---|---|---|
| 1,317,028 | 9/1919 | MacKay | 110/116 |
| 1,762,579 | 6/1930 | Krenz | 110/248 |
| 1,995,893 | 3/1935 | McEver | 110/248 |
| 3,552,334 | 1/1971 | Springer et al. | 110/214 |
| 3,563,189 | 2/1971 | Osburn | 110/240 |
| 3,742,875 | 7/1973 | Eberle | 110/116 |
| 3,897,739 | 8/1975 | Goldbach | 110/216 |

*Primary Examiner*—Kenneth W. Sprague
*Attorney, Agent, or Firm*—Paul M. Denk

[57] ABSTRACT

An apparatus for providing total combustion of burnable waste materials and which includes a housing mounted upon a series of wheels that furnishes it with portability, the housing forming a firebox having a pair of upper and lower combustion chambers therein, a pair of feed chutes for feeding the combustion chambers, respectively, a closure means pivotally connecting to the housing and providing for coverage of the feed chutes and entrance into the combustion chambers during apparatus operation, a flue connecting to the housing, above the combustion chambers, and extending partially into the upper or secondary combustion chamber, an exhaust stack provided upon said flue, said exhaust stack including a series of cylindrical sections, being of different diametric sizes, with the sections of greater diameter partially lapping and extending above the sections of lesser diameter therebelow, and a truncated shaped stack section connecting upon the uppermost cylindrical section for exhausting the gases of combustion from the apparatus after completion of their full combustion within the secondary combustion chamber and the flue and exhaust stack.

19 Claims, 12 Drawing Figures

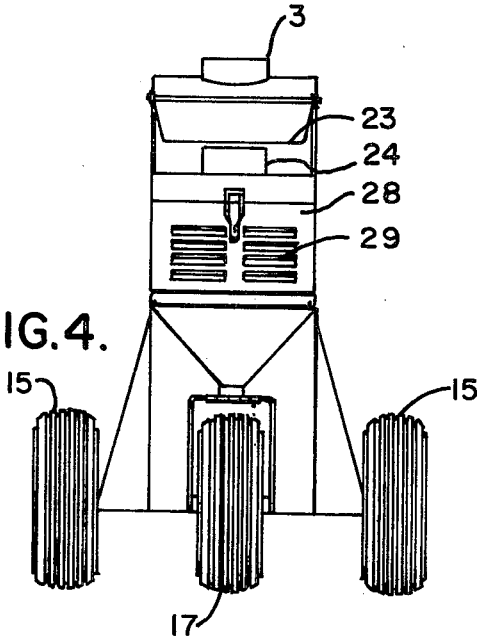
FIG.4.
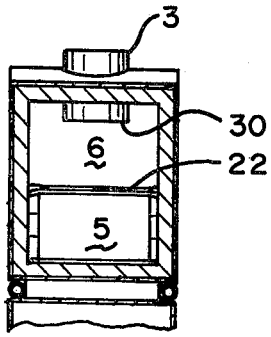
FIG.5.
FIG.6.
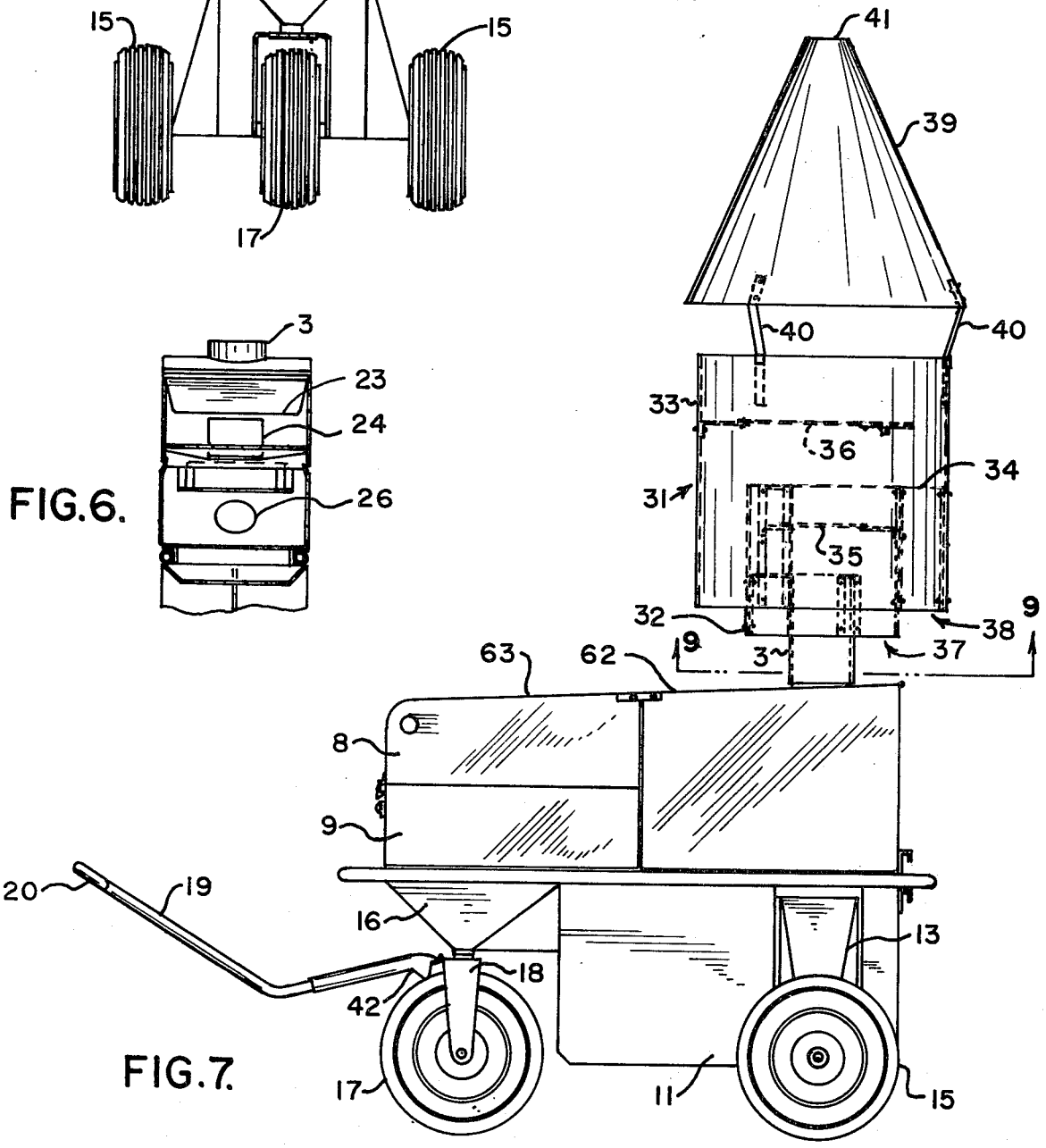
FIG.7.

INCINERATING AND ENERGY CONVERTING APPARATUS

BACKGROUND OF THE INVENTION

This invention relates to an incinerating apparatus, but more specifically pertains to an incinerating apparatus that has utility for providing energy conversion and does so with significantly reduced pollution.

For the past decade considerable emphasis has been placed upon the environmental aspects of our society, and most prominent has been the reduction in the amount of industrial and residential pollutants that are emitted into our atmosphere. The most significant piece of evidence of this concern has been the culmination of legislation in 1967 under the title of the "Air Quality Act of 1967", more commonly known as the Clean Air Act. Generally, the Act was enacted for the primary purpose to protect and enhance the quality of the Nation's air resources so as to promote the public health and welfare and the productive capacity of its population. More specifically, the Act stimulates cooperative activities of the various state jurisdictions, and their local laws, to provide for uniformity of legislation that seeks the aforesaid ultimate goal of the prevention and control of air pollution. Thus, many state legislatures, and municipal legislative assemblies, have fulfilled this need by also enacting laws that stringently control and regulate the quantity of pollutants that are emitted in thier ambient atmospheres.

But, even in view of the foregoing, many if not most of the incinerating, burning, and cooking units that readily give off their gases of combustion to the atmosphere have not been designed to fulfull the purposes of such enacted legislation, that, as previously explained, present strictures on the quantity of pollutants that may be disseminated in gaseous form into our atmosphere. As an example, the various style of portable cooking units, generally identified as barbecuing devices, and such as shown in the United States patent to Tidwell, U.S. Pat. No. 3,991,666, discloses a rather complex pit and oven combination which readily burns charcoal or other combustible matierals under an open grate, thereby emitting its polluting gases and smoke directly into the surrounding atmosphere. The United States patent to Wyrough, U.S. Pat. No. 3,602,161, discloses an incinerator for trash or other waste material which includes a lower trash-receiving chamber, and an upper smoke incinerating chamber, both for the purpose of providing for extra burning of its deposited waste material, but it can be seen that its upper chamber provides for direct discharge of its smoke uninhibitively out of its integral stack and to the atmosphere, all without any supplemental treatment or means to provide reduced contamination from such discharge. One of the most notorious or pollutants is the smoke given off of the burning of various elastomeric and polymeric materials, such as rubber and plastics. The United States patent to Stockman, U.S. Pat. No. 3,572,265, recognizes this problem, and provides some means for remedying the same through the use of multiple burners for initially heating and gasifying of such solid waste, and with a further attempt to reduce the carried pollutants in the fumes by causing an after burning of said fumes within the emitting stack. Baffling means have been tried for reducing pollutants, and as can be seen in the United States patent to Overfield, U.S. Pat. No. 3,334,598, an oil fired household garbage incinerator incorporating breather ports for assuring what this device seeks as the prompt discharge of its gases and fumes, at least during initial garbage ignition.

The foregoing incinerators have been helpful in providing some reduction in the quantity of pollutants admitted to the atmosphere, over the type of incinerating devices which were earlier devised, such as shown in the United States patent to Egan, U.S. Pat. No. 2,127,328, but, by and large, these more contemporary incinerators are more concerned with providing means for reduction of solid waste material, on a more bulk scale, and are not generally concerned with the amount of pollutants that may be generated therefrom, once the discarding of the solid waste has been effected, as through incineration.

Various other incinerators of the foregoing types are shown in the United States patent to Matteini, U.S. Pat. No. 3,412,697; the United States patent to Franzheim, U.S. Pat. No. 3,044,42; the United States patent to Royer, U.S. Pat. No. 2,882,842; the United States patent to Hartmann, U.S. Pat. No. 2,956,526; the United States patent to Morgan, U.S. Pat. No. 3,089,440; the United States patent to Shaw, U.S. Pat. No. 3,610,179; and the two United States patents to Hoskinson, U.S. Pat. Nos. 3,215,101, and 3,248,178. These are all examples of the known extent of the development of the state of the art with respect to this particular field of technology.

In view of the foregoing, it is, therefore, the principal object of this invention to provide an energy converting apparatus which combines the feature of solid waste incineration, substantially reduced pollutant discharge, and energy conversion by way of steam pressure or provision of a heat source, as for use in cooking or heating, all embodied within a single structure.

Another significant object of this invention is the provision of means for providing total combustion of a burnable solid waste material and an after burning of its generated gases of combustion in an effort to significantly reduce if not eliminate the polluting characteristics normally carried by smoke or other discharge into the atmosphere.

Another object of this invention is to provide for the use of dual combustion chambers for inducing forced burning at significantly elevated temperatures of solid waste material for attaining complete combustion.

Yet another object of this invention is to furnish an incinerating apparatus that may incorporate boiler tubes for providing a supplemental means for generating of usable energy.

Yet another object of this invention is to provide a solid waste incinerating apparatus which can give off a significant amount of tapable heat energy that may be used for heating purposes, such as for a living enclosure, or even for use for cooking, or other heat consuming purposes.

Yet still another object of this invention is to provide a novel exhaust stack for an incinerating apparatus that assures the full exposure of the heated flue gases to an abundant quantity of oxygen to assure complete combustion and elimination of the polluting aspects of smoke before its discharge to the atmosphere.

Another object of this invention is to provide means for purifying the exhaust from an incinerating apparatus so that smoke discharge will be clear, and free of any soot and the usual unspent hydrocarbons that normally furnish the deleterious polluting aspects to this type of smoke exhaust.

Yet another object of this invention is to provide an incinerating apparatus having supplemental beneficial aspects as a secondary energy source that is easy to use, compact in structure, and low in cost to manufacture.

Yet a further object is to provide an incinerating apparatus having the foregoing advantages and which is readily portable for ease of mobility around the property.

These and other objects will become more apparent to those skilled in the art upon reviewing the summary of this invention, and upon undertaking a study of its preferred embodiment in view of the drawings.

SUMMARY OF THE INVENTION

This invention contemplates the formation of a housing, preferably wheel mounted to enhance its portability, with its housing being segregated into a pair of combustion chambers, one above the other, the first chamber comprising a primary combustion chamber, and into which most of the solid waste hydrocarbon material, and wood, leaves, etc., will be inserted, and having the secondary combustion chamber arranged directly thereabove and into which additional quantities of combustible material will be inserted so as to provide for secondary burning not only for eliminating its waste, but to provide for an afterburning of the flue gases and before they are discharged from the apparatus stack. As is well known, various types of trash may give off slight gases in the category of methane, ethane, or ethylene, and when the trash is burned, in addition to its evolved gas, are combusted into carbon dioxide and mositure or water vapor. In the concept of eliminating pollution, particularly from flue gases and smoke, it is desirable that the end product generated from the same will be a pure carbon dioxide and water. But achieving this has not been, in the past, a primary goal, and since the incipiency of the various clean air laws, as previously explained, to attain a more pure or clearer flue gas, or more specifically, a smokeless trash destruction by combustion, such has just not been an easy feat to attain.

The current invention recognized the foregoing problems, provides a particularly styled incinerating device which seeks to attain a high temperature of heat, during its operation, maintain the same for some period of time, so that all of the flue gases generated within the apparatus, and before the same are exhausted, will be subjected to these elevated temperatures, fully oxidized, and completely combusted, thereby eliminating the conveyance of any of the entrained hydrocarbons, which are usually the deleterious particles forming the smoke, before they are conveyed for discharge to the atmosphere. Secondary benefits derived from the current invention, structured as previously explained, include means for utilization of the solid waste or burnable cellulostic material, as for example, for generating of a heat source, which can be tapped for heating of the residence, or other building, and likewise furnish energy for cooking, or even for industrial uses. Thus, other national resources or energy that are very apparently becoming in short supply, such as gas or electricity, can be conserved. Thus, an invention of this type, as distinct from the earlier type of incinerating devices made available, and as previously explained, can provide a form of solution to the elimination of solid combustible waste, while simultaneously offering, at least on the residential or small industrial scale, a means for conserving energy by attaining its supply from this alternate source, and do so with little formed pollution.

It is essential that the current invention maintain a high degree of temperature within its apparatus, so that as previously explained, full combustion will take place and incomplete combustion eliminated, which is usually caused from lower temperatures generated within certain types of earlier incinerating devices. It is this incomplete combustion that allows for the various hyhdrocarbons to become entrained within the flue gas exhaust, and be harmfully discharged into the atmosphere. To attain such elevated heat, the current invention does incorporate the dual combustion chambers, one above the other, and each of which chamber has associated therewith a feed chute that can provide for a batch or continuous flow of combustible waste material into its respective chambers. The continuous supply of combustible hydrocarbon material into these chambers maintains a continuous burn, and the development of significant heat therein during functioning. The invention further comprehends the use of even forced burning in order to maintain the elevated heat desired, since it has been found, through experimentation, that most of the carbonaceous components within flue gases can be fully burned at a temperature above 1500 degrees F. An example of forced burning may include the use of one or more compressed gas burners, such as propane, or the like, which may discharge its flame directly into the primary and/or secondary combustion chambers for stimulating a continuous heavy flame within said chambers in order to insure full combustion. Furthermore the flue of the apparatus, that which communicates with the secondary and upper combustion chamber, may extend slightly downwardly therein so as to provide a momentary retention of the heated gases within the upper chamber and provide for their continuous exposure to the high heat generated within the combustion chambers before they are discharged from the stack to the atmosphere.

Through usage of this invention, and with the use of various temperature and chemical detecting devices the temperature and component profile of this current apparatus provided the following results:

| Operating Time | 15 | 20 | 30 | 35 | 40 | 45 | 50 | 60 | 67 | 69 | 72 | 82 |
|---|---|---|---|---|---|---|---|---|---|---|---|---|
| Fuel Input: (Cumulative) (lbs.) | | | 10 | | | 20 | | | | 30 | | |
| Temperatures: (° F.) | | | | | | | | | | | | |
| Stack Outlet: | | | | | | | | | | 600 | 670 | |
| Stack Center: | | | | | | | | | | | | |
| Firebox Top: (Exterior) | 29.5 | 333 | 415 | 430 | 465 | 395 | 500 | 505 | | | | |
| Combustion Chamber: (Lower) | | | | | | | | | | | 1675 | |
| Gas Measurements: | | | | | | | | | | | | |
| Percent $CO_2$ | | | | 8.0 | | | | | | | | |
| Percent $O_2$ | | | | | | 20.8 | | | | | | |

As can be seen, the temperatures within the main combustion chambers of this invention, and more specifically in the region of the lower combustion chamber, after an incremental time of apparatus operation, sustains a temperature in excess of this 1600° C., which is a rather hot heat for any incinerating type of apparatus, and thereby provides for the full combustion of all of the solid waste material fed into both the primary and secondary combustion chambers, in addition to providing for full combustion of any remaining hydrocarbons that may be entrained within the flue gases of combustion before they escape around the downwardly depending flue for conveyance to the atmosphere. Tests have indicated that the temperature within the various combustion chambers have even exceeded 2000° F. and maintained at that temperature, in order to attain the complete combustion desired from this invention.

Various other attributes of this invention include the locating of the apparatus within a specially designed enclosure, one that may be vented, but yet provided with sufficient coverage so as to prevent the entrance of any elements therein. Thus, at that instance where the device may be used for generating steam pressure, it can be fully operated even during inclement weather, so as to furnish that type of supplemental energy source continuously, and without obstruction. The uniquely designed stack of this invention incorporates means for the continuous feeding of oxygen to the discharging flue gases, so that even a final slight combustion may take place upon exposure of the added oxygen to the heated gases, so as to eliminate, fully, the deleterious hydrocarbonaceous aspects of smoke before it reaches the atmosphere During testing, this invention, when properly operating, and burning waste material, discharges flue gases that are clear to vision, thereby complying with local ordinances against the discharge of any smoke from residential burning.

BRIEF DESCRIPTION OF THE DRAWINGS

In the drawings,

FIG. 4 furnishes a front view of the incinerating apparatus;

FIG. 5 discloses a partial sectional view showing the primary and secondary combustion chambers taken along the line 5—5 of FIG. 2;

FIG. 6 furnishes a partial sectional view of the apparatus disclosing the feed chutes leading towards their respective combustion chambers, taken along the line 6—6 of FIG. 2;

FIG. 7 furnishes a complete side view of the apparatus, also showing its integral stack mounted upon the apparatus flue;

DESCRIPTION OF THE PREFERRED EMBODIMENT

Figure 1:
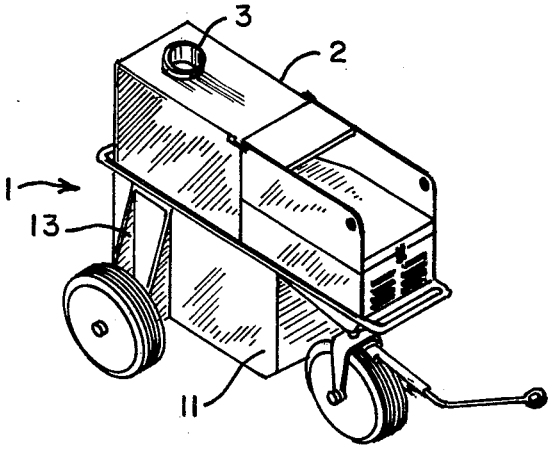
FIG.1 discloses an isometric view of the incinerating and energy converting apparatus of this invention.
Figure 2:
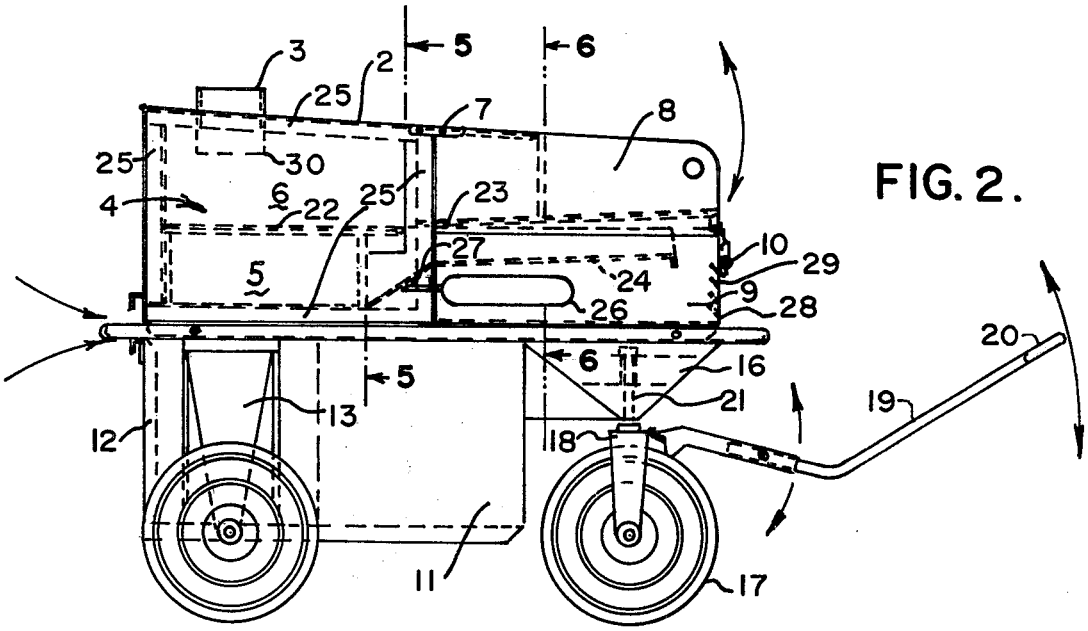
FIG. 2 provides a side view of the incinerating apparatus shown in FIG. 1, and further disclosing, in hidden line, its internally arranged operative components.
Figure 3:
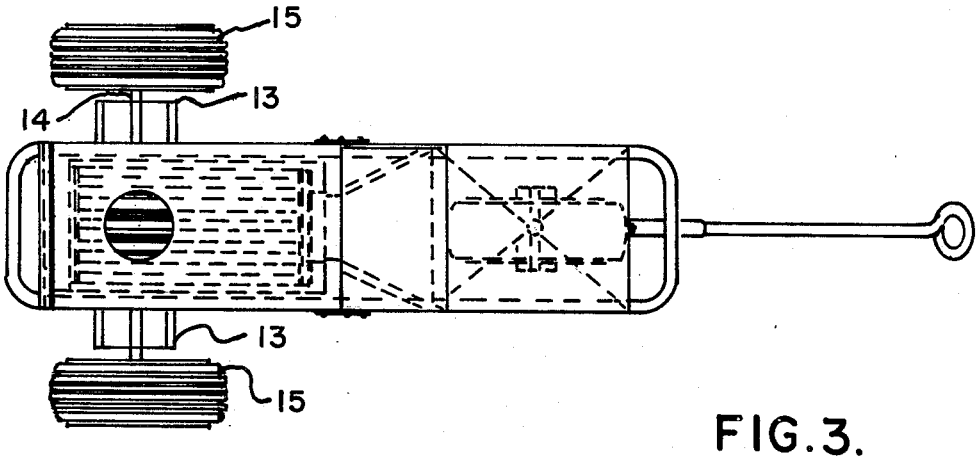
FIG. 3 furnishes a plan view of the incinerating apparatus.

In referring to FIG. 1 of the drawings, there is disclosed the incinerating and energy converting apparatus 1 of this invention. As can also be seen in FIGS. 2 through 4, the apparatus includes a housing 2 having a flue 3 extending upwardly from the upper surface of said housing, with the housing 2 having a fire box, as at 4, provided therein and in which the fires of combustion occur during usage of this invention. The housing firebox is formed into two compartments, comprising the primary and secondary combustion chambers 5 and 6, respectively, and in which the burning of the combustible hydrocarbon waste materials occurs. Pivotally mounted proximate its upper end, as at 7, is a closure means 8, and which rests upon a lower base 9, being held thereto by means of a locking mechanism 10.

Extending downwardly from the housing 2, and the base 8, is a compartment 11, which may be used for storage of other instruments, or even kindling, having access thereto through the door 12. Extending from either side of the storage compartment 11 are the standards 13, which cooperate for holding an axle 14 for mounting of the rear wheels 15. Projecting downwardly at the frontal end of the apparatus, and beneath the base 9, is a frame member 16 that is useful for pivotally mounting of the directional wheel 17, as shown. Connecting with the yolk 18 of the wheel 17 is a tow bar 19, having a handle 20 located at its forwardmost end, and which is useful for providing the means for pulling of the apparatus, in addition to giving the direction of movement to the front wheel 17, and therefore, the entire apparatus. As can be seen, the yolk 18 has a shaft 21 extending upwardly therefrom, and which is bearing mounted within the frame member 16. The tow bar also furnishes a brake 42 that can be pressed against the tire 17 for curtailing movement.

As previously commented, the firebox 4 is segregated into a pair of upper and lower, secondary and primary combustion chambers, respectively, and which chambers are separated by means of the grate 22. Thus, any waste material for burning deposited within the primary combustion chamber 5, when ignited, will direct its flame upwardly through the grill 22 and furnish a burning of similar material deposited within the secondary combustion chamber 6. To attain deposition of waste combustible material into firebox there is provided a chute means associated with each of the combustion chambers. An upper chute means 23 is useful for feeding combustible material into the secondary combustion chamber 6, while a lower chute means 24 facilitates the delivery of the combustible material into the primary combustion chamber 5. It may also be commented that in order to insure the adequate build up of heat, and retention of the same, within the fire box that insulation, such as refractory material, as in the category of DB No. 1 firebrick, as at 25, is provided for surrounding the said firebox, and therein insure an adequate build up of heat within the same. And, this firebrick insulation is surrounded by the housing 2, which may be formed of a sheet metal material of sufficient thickness to provide structural rigidity to the said housing, withstand deterioration, particularly that which may be caused by continuous exposure to heat and some moisture, but at the same time, being sufficiently thin so as to reduce the weight of the entire apparatus.

Provided below the lower chute 24, and in the base 9, may be located structural means useful for supporting a compressed gas burner, such as the propane burner 26, and which directs its nozzle 27 into the lower combustion chamber 5 for ejection of a flame into the same. This particular burner is optional in the device, since it has been found, through experimentation, that the degrees of heat built up in both the primary and as a result the secondary combustion chambers of this invention are adequate for furnishing that heat found necessary for attaining full combustion of all of the hydrocarbon aspects of the waste materials being burned. Also located within this base 9, and more specifically formed through its frontal panel 28, is a vented opening 29 that allows for the entrance of air into the vicinity of the firebox, so as to provide for the access of oxygen for feeding of the fires of combustion therein for sustaining the operations of this invention.

Figure 8:
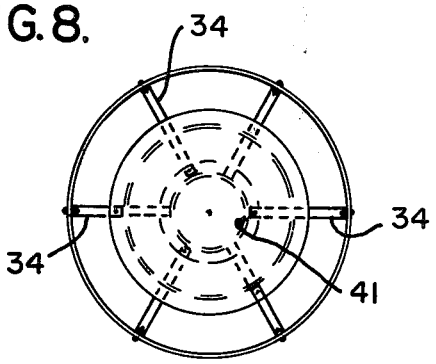
FIG. 8 furnishes a top view of the exhaust stack.
Figure 9:
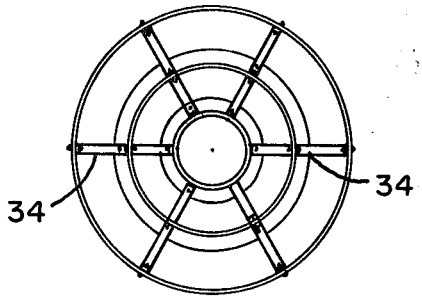
FIG. 9 furnishes a bottom view of the exhaust stack, taken along the line 9—9 of FIG. 7.

It can be seen that the flue 3 of the housing, may extend partially downwardly into the secondary combustion chamber 6, as can be seen at 30, and this is useful for providing for some accumulation of heat at the upper regions of the secondary combustion chamber so that sufficient hotness is maintained at that location, and which stimulates the complete burning of all of the waste materials, in addition to preventing the entrainment and exhausting of any of the carbonaceous elements that may be exhausted by the stack of this apparatus. In referring to also FIGS. 7 through 9 of the drawings, mounted upon the flue 3 is the exhaust stack 31 of this invention. This exhaust stack includes a series of cylindrical sections as at 32 and 33, with the section 32 being of greater diameter than the flue 3, but of lesser diameter than the outer concentrically arranged stack section 33. These sections are all secured together by means of a bracing, as at 34, and a series of baffles, as at 35 and 36, may be partially arranged across each of the stack sections so as to provide some cascading of the flue gases of exhaustion as they rise upwardly through the stack for emission into the atmosphere. In any event, because of the different diametric sizes of these various stack sections, and their partial overlapping in their shown vertical arrangement, sufficient clearance is provided, as at 37 and 38, for allowing the reentrance of air, and more specifically oxygen, into the stack for insuring complete combustion of the flue gases as they rise out of the apparatus. A truncated shaped stack section 39 is held by bracing 40 to the larger stack section 33, arranged therebelow, and with the truncated stack section having a reduced diameter opening, as at 41, so as to provide for a channelling of the exhaust gases out of a smaller or confined area when discharged into the atmosphere. As can be seen in FIGS. 8 and 9, various bracings, as previously explained at 34, are useful for securing these various stack sections, including the upper truncated stack section, by means of its bracing 40, together, and in combination providing for their mounting upon the top of the apparatus flue 3.

Figure 10:
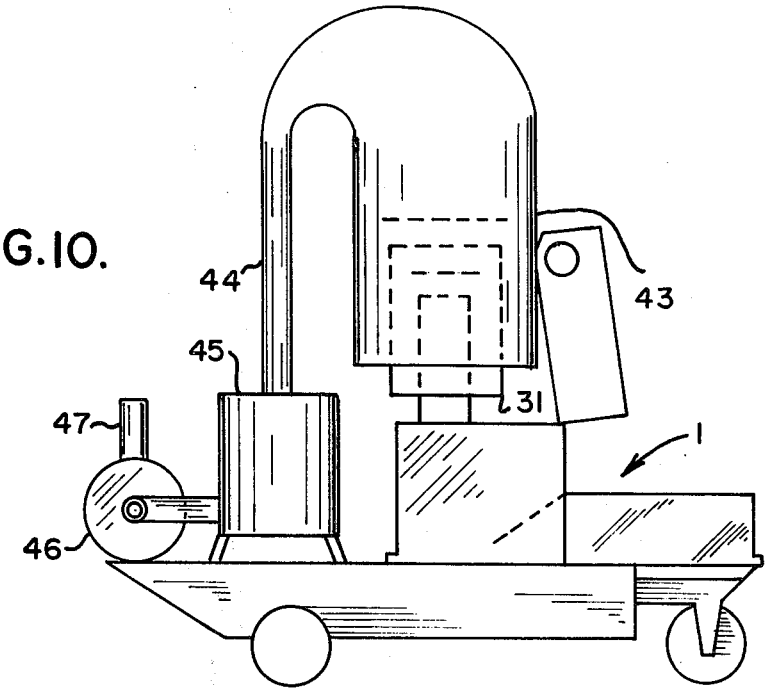
FIG. 10 discloses a modification to the apparatus wherein its flue gases are conveyed by means of a directed blower through a boiler for generation of steam.

Since this invention does comprehend various energy conversion means, furnishing supplemental usage for the apparatus, by referring to FIG. 10, it can be seen that the apparatus 1 may be used in combination with a boiler 2 for providing a generation of steam, and which steam may be used for various heating or pressure usage, as for turning of a turbine, when used in the generation of electricity. As can be seen, the upper stack portion 43 functions as a hood upon the other stack section 31, as previously analyzed, and which hood 43 communicates with the ductwork 44 for channelling the flue gases through the boiler, and wherein they may heat any fluid contained within the boiler tubes (not shown) for use in the generation of steam or the like. A low pressure fan or blower 45 may be used for attracting the flue gases through the hood 43, and the duct 44, to the vicinity of the boiler, and then exhaust the flue gases out of its port 46, for venting them to the atmosphere.

Figure 11:
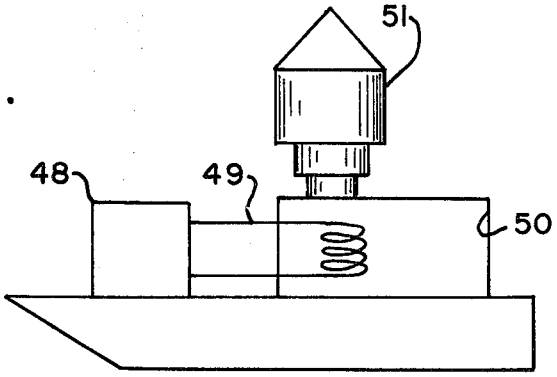
FIG. 11 discloses a modification to the apparatus showing the arrangement of the boiler tubes within its combustion chambers for generation of supplemental energy.

As can be seen in FIG. 11, the boiler 48 may simply dispose its tubes 49 in heat exchanging relationship through the various combustion chambers within the firebox 50, wherein the heated combustion gases may be used for creating high pressure steam, in the boiler, for other uses, as for example, in the generation of electricity, to provide heat, to run air conditioning or heating systems, or the like, as previously explained. In this particular example, the spent gases of the combustion, which will have been rendered sufficiently clear of any hydrocarbons by means of the primary and secondary combustion that takes place within the firebox 50, will be vented to the atmosphere through the stack 51.

Figure 12:
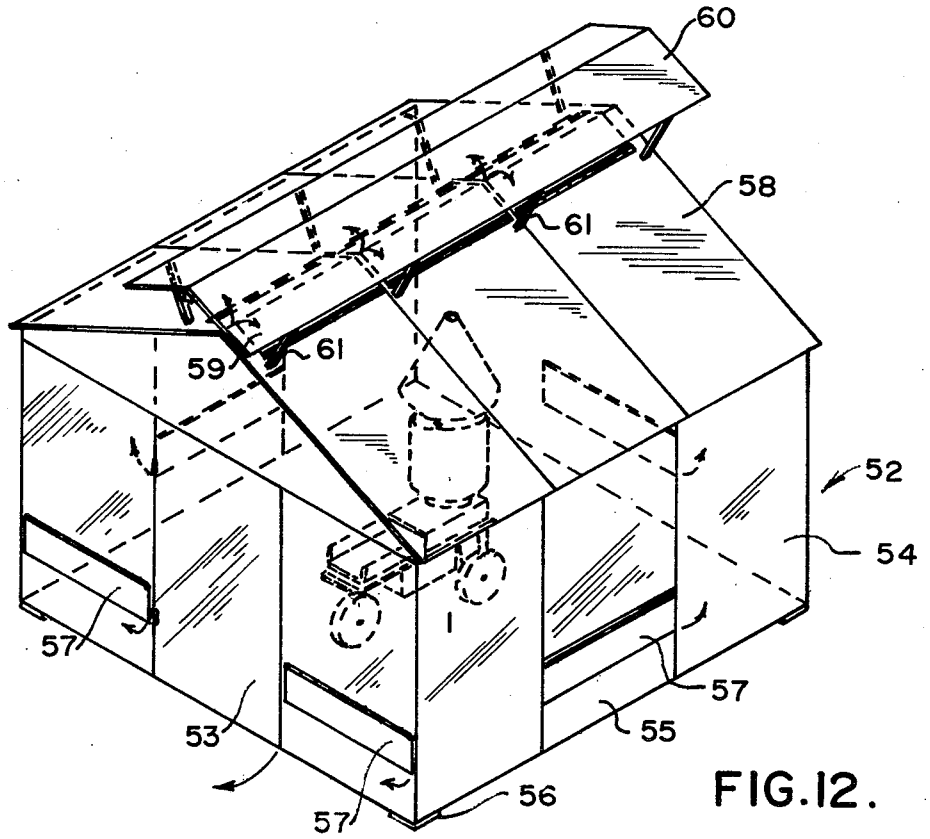
FIG. 12 provides a perspective view of a specially designed enclosure for housing of the incinerating and energy converting apparatus of this invention.

FIG. 12 discloses an enclosure 52 that may be used for housing of the apparatus 1, so that the apparatus may be continuously fired for indefinite durations and freed from exposure to increment or cold weather conditions. The enclosure includes a series of walls 53 and 54, resting upon a bottom frame 55, and which bottom frame may include various leveling shims, as at 56, for allowing installation of the enclosure even on rough terrain. Each of the wall panels 53 and 54 include a series of pivotally opening vent panels 57, useful for being opened so as to provide for this supplying of air, and oxygen, to the interior of the enclosure for feeding the fires of combustion taken place within the incinerating apparatus 1. The upper roof of the enclosure 52 may be slanted, as shown at 58, with the ridge of the roof incorporating one or more roof vents 59, which may be pivoted open, as can be seen schematically within the drawing, so as to provide for ready egress of the spent flue gases out of the enclosure. A cupola section, as at 60, is held by a series of supports 61, upwardly from a roof vent 59, so as to allow for the exhausting of the gases of combustion from the enclosure, while preventing the entrance of any rain, snow, or other elements into the interior of the enclosure during its usage.

It has been found during experimentation with this apparatus that the various upper surfaces of the apparatus, such as the upper surface 62 of the housing 2, or the upper surface 63 of the closure member, or even the upper feed chute 23, are sufficiently heated during the usage of this apparatus so as to support the cooking of any items or foods resting thereupon, thereby allowing this device to have ready usage, as for recreational purposes, when located at, for example, a clubhouse, or the like. Thus, this particular invention has ready application for a variety of purposes, and, as its name implies, provides for not only elimination of waste materials, but while said waste materials are being combusted, the device may be used for energy conversion purposes, for providing heat, steam for generation purposes, or even for common cooking, as at a vacation cottage, or the like.

Various modifications to the structure and usage of this invention may occur to those skilled in the art upon reviewing the subject matter of this invention. Such modifications, if within the spirit and scope of this invention, and if encompassed by the claims, are intended to be protected by any United States patent issuing hereon. The description set forth is made for illustrative purposes only.

Having thus described the invention what is claimed and desired to be secured by Letters Patent is:

1. An apparatus for fully burning of waste combustible materials with reduced dissemination of pollutant fumes comprising a housing, said housing incorporating a firebox, said firebox being segregated into two chambers, one of said chambers being a primary combustion chamber, the other of said chambers being an upper disposed secondary combustion chamber, a grate member separating said chambers, said secondary combustion chamber being structurally arranged directly above the primary combustion chamber, said combustion chambers being lined with insulation, access means providing entrance into both said chambers for deposition of waste combustible material therein, wherein upon ignition of said combustibles arranged in the said chambers, the burning in the secondary chamber acts to provide a complete forced combustion of any hydrocarbonacous materials entrained within the egressing flue gases, a feed chute associated with each of the access means into the combustion chambers, said feed chutes extending forwardly of the said housing, the said feed chutes being disposed for facilitating the deposition of waste materials into each of the primary and secondary combustion chambers during operation of the apparatus, a flue connecting to and providing for gas discharge from said chambers, said flue extending downwardly some distance into the secondary combustion chamber, an exhaust stack provided upon said flue, the stack providing for intermixing of the said flue gases with oxygen to insure complete combustion before emission of the said gases into the atmosphere, said stack including a series of cylindrical sections, each section being of different diameter, the said sections being partially concentrically arranged and having the greater diametric sections partially lapping and extending above a section of lesser diameter, a baffle means structurally securing within the cylindrical sections and providing a circuitous path for flow of the exiting flue gases.

2. An apparatus for fully burning of waste combustible materials with reduced dissemination of pollutant fumes comprising a housing, said housing incorporating a firebox, said firebox being segregated into two chambers, one of said chambers being a primary combustion chamber, the other of said chambers being an upper disposed secondary combustion chamber, a grate member separating said chambers, said secondary combustion chamber being structurally arranged directly above the primary combustion chamber, and said combustion chambers being aligned with insulation, storage space provided beneath the insulated housing, and access means provided upon said storage space, a flue connecting to and providing for gas discharge from said chambers, access means providing entrance into both said chambers for deposition of waste combustible material therein, wherein upon ignition of said combustibles arranged in the said chambers, the burning in the secondary chamber acts to provide a complete forced combustion of any hydrocarbonacous materials entrained within the egressing flue gases, feed chutes associated with each of the access means into the combustion chamber, said feed chutes extending forwardly of the said housing, and said feed chutes being disposed for facilitating the deposition of waste materials into each of the primary and secondary combustion chambers during operation of the apparatus.

3. An apparatus for fully burning of waste combustible materials with reduced dissemination of pollutant fumes comprising a housing, said housing incorporating a firebox, said firebox being segregated into two chambers, one of said chambers being a primary combustion chamber, the other of said chambers being an upper disposed secondary combustion chamber, a grate member separating said chambers, said secondary combustion chamber being structurally arranged directly above the primary combustion chamber, said combustion chambers being lined with insulation, a flue connecting to and providing for gas discharge from said chambers, said flue extending downwardly some distance into the secondary combustion chamber, access means providing entrance into both said chambers for deposition of waste combustible material therein, wherein upon ignition of said combustibles arranged in the said chambers, the burning in the secondary chamber acts to provide a complete forced combustion of any hydrocarbonacous materials entrained within the egressing flue gases, a feed chute associated with each of the access means into the combustion chambers, said feed chutes extending forwardly of the said housing, and said feed chutes being disposed for facilitating the deposition of waste materials into each of the primary and secondary combustion chambers during operation of the apparatus.

4. The invention of claim 3 and including a closure member for the apparatus, said closure member being pivotally connected to the apparatus and capable of preventing access into the combustion chambers during apparatus operation, said closure member being elongated and when shut providing for coverage of the feed chutes of the apparatus.

5. The invention of claim 4 and including a base member supporting the said closure member, said base member at its frontal end including an air intake for feeding oxygen to the combustion chambers during apparatus operation.

6. The invention of claim 5 and including guard means surrounding the apparatus to regard the inadvertent contact with the housing firebox.

7. The invention of claim 6 wherein said apparatus is portable.

8. The invention of claim 7 and including a series of wheels supporting said portable apparatus.

9. The invention of claim 8 wherein one of said wheels comprises a directional wheel and is capable of turning for providing unlinear movement to the apparatus.

10. The invention of claim 9 and including bar means operatively connected with said directional wheel to provide the means for turning of said wheel during apparatus movement.

11. The invention of claim 3 and including an exhaust stack provided upon said flue, said stack providing for intermixing of the said flue gases with oxygen to insure complete combustion before emission of the said gases into the atmosphere.

12. The invention of claim 11 wherein said stack includes a series of cylindrical sections, each section being of different diameter, the said sections being partially concentrically arranged and having the greater diametric sections partially lapping and extending above a section of lesser diameter.

13. The invention of claim 1 and including a truncated stack section connecting upon the uppermost cylindrical section of the stack and useful for exhausting the gases of combustion from its upper reduced size aperture.

14. The invention of claim 13 and including brace means structurally securing the cylindrical and truncated stack sections together.

15. The invention of claim 3 and including a boiler means, said boiler means including a series of tubes, said boiler tubes extending through at least one of said primary and secondary combustion chambers, and said boiler when operative having a supply of fluid therein for generating pressure from the heat prevailing in the said combustion chambers.

16. The invention of claim 11 and including a hood provided over the said stack, a duct communicating with said hood, a boiler, said boiler having a series of tubes, the boiler tube being exposed within the said duct, a blower connecting with the duct and when operative drawing the heated flue gases through the duct and across the boiler tubes for generating a pressure therein.

17. The invention of claim 3 and including an enclosure for the said apparatus, said enclosure having at least one vent opening therethrough, an exhaust outlet provided through the upper region of the enclosure, and said apparatus being disposed therein and when operating exhausting its gases of combustion through the enclosure outlet.

18. The invention of claim 17 and including closure means for the said exhaust outlet, said closure means being pivotal between opened and closed positions, and when opened the exhaust outlet allowing for escape of the gases of combustion from the operating apparatus and the enclosure.

19. The invention of claim 18 and including a cupola covering said exhaust outlet to allow for the exhausting of gases while preventing the entrance of the elements into the said enclosure.

* * * * *

UNITED STATES PATENT AND TRADEMARK OFFICE

CERTIFICATE OF CORRECTION

PATENT NO. : 4,144,824

DATED : March 20, 1979

INVENTOR(S) : Leonard C. Bartling

It is certified that error appears in the above-identified patent and that said Letters Patent are hereby corrected as shown below:

In claim 6, column 10, line 32 change "regard" to ---retard---.

Signed and Sealed this

*Twenty-sixth* Day of *June 1979*

[SEAL]

*Attest:*

RUTH C. MASON
*Attesting Officer*

DONALD W. BANNER
*Commissioner of Patents and Trademarks*